United States Patent [19]

Kawasaki et al.

[11] Patent Number: 4,717,435

[45] Date of Patent: Jan. 5, 1988

[54] GAMMA-PRIME PRECIPITATION HARDENING NICKEL-BASE YTTRIA PARTICLE-DISPERSION-STRENGTHENED SUPERALLOY

[75] Inventors: Yozo Kawasaki; Katsuyuki Kusunoki, both of Yokohama; Shizuo Nakazawa, Tokyo; Michio Yamazaki, Zushi, all of Japan

[73] Assignee: National Research Institute for Metals, Tokyo, Japan

[21] Appl. No.: 903,135

[22] Filed: Sep. 3, 1986

[30] Foreign Application Priority Data

Oct. 26, 1985 [JP] Japan ..... 60-238616

[51] Int. Cl.[4] ..... C22C 19/05

[52] U.S. Cl. ..... 148/410; 420/448

[58] Field of Search ..... 420/441, 443, 448; 148/410, 428

[56] References Cited

U.S. PATENT DOCUMENTS

| | | | |
|---|---|---|---|
| 3,591,362 | 7/1971 | Benjamin | 419/35 |
| 3,746,581 | 7/1973 | Cairns et al. | 419/29 |
| 3,776,704 | 12/1973 | Benjamin | 148/428 |
| 3,926,568 | 12/1975 | Benjamin et al. | 148/428 |
| 4,386,976 | 6/1983 | Benn et al. | 148/410 |

FOREIGN PATENT DOCUMENTS 48550 3/1986 Japan .

*Primary Examiner*—L. Dewayne Rutledge
*Assistant Examiner*—George Wyszomierski
*Attorney, Agent, or Firm*—Wenderoth, Lind & Ponack

[57] ABSTRACT

A gamma-prime precipitation hardening nickel-base yttria particle-dispersion-strengthened superalloy having a composition consisting essentially of, by weight, 3.0 to 6.0% of Al, 8.5 to 10.9% of Co, 3.9 to 7.5% of Cr, 0.5 to 1.2% of Ti, 3.6 to 6.3% of Ta, 11.4 to 13.3% of W, 0.02 to 0.2% of Zr, 1.3 to 2.6% of Mo, 0.001 to 0.1% of C, 0.001 to 0.02% of B, 0.5 to 1.7% of yttria ($Y_2O_3$), not more than 0.8% of O and the balance being Ni and having a structure composed of coarse recrystallized grains with a GAR of at least 20 and a short axis diameter of at least 0.5 mm, said alloy being produced by mechanically mixing a nickel carbonyl powder, element powders of Co, Cr, Ta, W and Mo, alloy powders of Ni—Al, Ni—Ti—Al, Ni—Zr and Ni—B, and a fine yttria powder in amounts to provide said composition, sealing the mixed powder into an extrusion can, extruding it, and subjecting the extruded material to zone annealing heat-treatment while its maximum temperature is within the range from its hardness softening temperature to its solidus temperature.

12 Claims, 1 Drawing Figure

GAMMA-PRIME PRECIPITATION HARDENING NICKEL-BASE YTTRIA PARTICLE-DISPERSION-STRENGTHENED SUPERALLOY

BACKGROUND OF THE INVENTION

1. Field of the Invention

This invention relates to a gamma-prime precipitation hardening nickel-base yttria particle-dispersion-strengthened superalloy.

More specifically, this invention relates to a gamma-prime precipitation hardening nickel-base yttria particle-dispersion-strengthened superalloy having excellent creep rupture strength.

The output or thermal efficiency of gas turbines used in jet engines or power plant facilities can be most effectively increased by elevating the temperature of combustion gases. For this purpose, blade materials having high creep rupture strength at high temperatures are required.

2. Description of the Prior Art

R. Irmann, Metallurgia, 49 (1952), page 125 describes a sintered aluminum product (SAP).

U.S. Pat. No. 2,972,529 discloses oxide dispersion-strengthened alloys such as TD Ni and TD Ni—Cr developed by utilizing the teaching of the above-cited literature reference. These alloys, however, have low creep rupture strength at intermediate temperatures region, and lack corrosion resistance.

U.S. Pat. No. 3,591,362 discloses an alloy producing method called the mechanical alloying method (MA method). This method enabled the production of oxide-dispersion strengthened superalloy with gamma-prime precipitates having fine oxide. The alloys disclosed in this patent, however, have a low grain aspect ratio (GAR), i.e. the ratio of the longitudinal length to its tansverse length, of a crystal grain and their creep rupture strength is not high.

U.S. Pat. No. 3,746,581 discloses that an alloy having a structure of a high GAR is obtained by the zone annealing method by which an extruded material produced under suitable extruding conditions is moved in a furnace having a temperature gradient.

U.S. Pat. Nos. 3,746,581 and 3,926,568 and Y. G. Kim and H. F. Merrick, NASA CR-159493, May 1979 describe alloys such as MA6000 produced by using the aforesaid MA method and zone annealing method. MA6000 alloy, one of the best alloys now on the market, is produced by mechanically mixing elemental powders, alloy powders and yttria so as to provide the desired alloy composition, extruding the mixture, and subjecting the extruded material to zone annealing heat-treatment. The resulting alloy is a gamma-prime phase precipitation hardening nickel base alloy dispersion-strengthened with fine particles of yttria. MA6000 alloy has a creep rupture strength at high temperatures of about 1,400 hours under creep conditions of 1,050° C. and 16 kgf/mm$^2$, which is higher than those of ordinary cast and single crystal alloys. But from the standpoint of the alloy design, it is not fully solid solution-strengthened, and particularly the balance between the contents of chromium and high-melting metals (W and Ta) is not satisfactory.

Japanese patent application No. 168761/1984 having the same inventorship as the present application, which was filed in Japan on Aug. 14, 1984, i.e. before the Convention priority date (Oct. 26, 1985) of the present application, and laid open to public inspection as Japanese Laid-Open Patent Publication No. 48550/1986 on Mar. 10, 1986, i.e. after the Convention priority date, describes a gamma-prime precipitation hardening nickel-base yttria particle-dispersion-strengthened superalloy having quite a different alloy composition from MA6000. This alloy is produced without zone annealing heat-treatment. Under creep conditions of 1,050° C. and 16 kgf/mm$^2$, this alloy has a creep rupture strength of about 3,500 hours, which is higher than that of MA6000, but is still not entirely satisfactory.

SUMMARY OF THE INVENTION

It is an object of this invention to provide a gamma-prime precipitation hardening nickel-base yttria particle-dispersion-strengthened superalloy having higher creep rupture strength at high temperatures than conventional counterparts.

According to this invention, the above object is achieved by a gamma-prime precipitation hardening nickel-base yttria particle-dispersion-strengthened superalloy having a composition consisting essentialy of, by weight, 3.0 to 6.0% of Al, 8.5 to 10.9% of Co, 3.9 to 7.5% of Cr, 0.5 to 1.2% of Ti, 3.6 to 6.3% of Ta, 11.4 to 3.3% of W, 0.02 to 0.2% of Zr, 1.3 to 2.6% of Mo, 0.001 to 0.1% of C, 0.001 to 0.02% of B, 0.5 to 1.7% of yttria ($Y_2O_3$), not more than 0.8% of O and the balance being Ni and having a structure composed of coarse recrystallized grains with a GAR of at least 20 and a short axis diameter of at least 0.5 mm, said alloy being produced by mechanically mixing a nickel carbonyl powder, element powders of Co, Cr, Ta, W and Mo, alloy powders of Ni—Al, Ni—Ti—Al, Ni—Zr and Ni—B, and a fine yttria powder in amounts to provide said composition, sealing the mixed powder into an extrusion can, extruding it, and subjecting the extruded material to zone annealing heat-treatment while its maximum temperature is within the range from its hardness softening temperature to its solidus temperature.

DETAILED DESCRIPTION OF THE PREFERRED EMBODIMENTS

Figure 1:
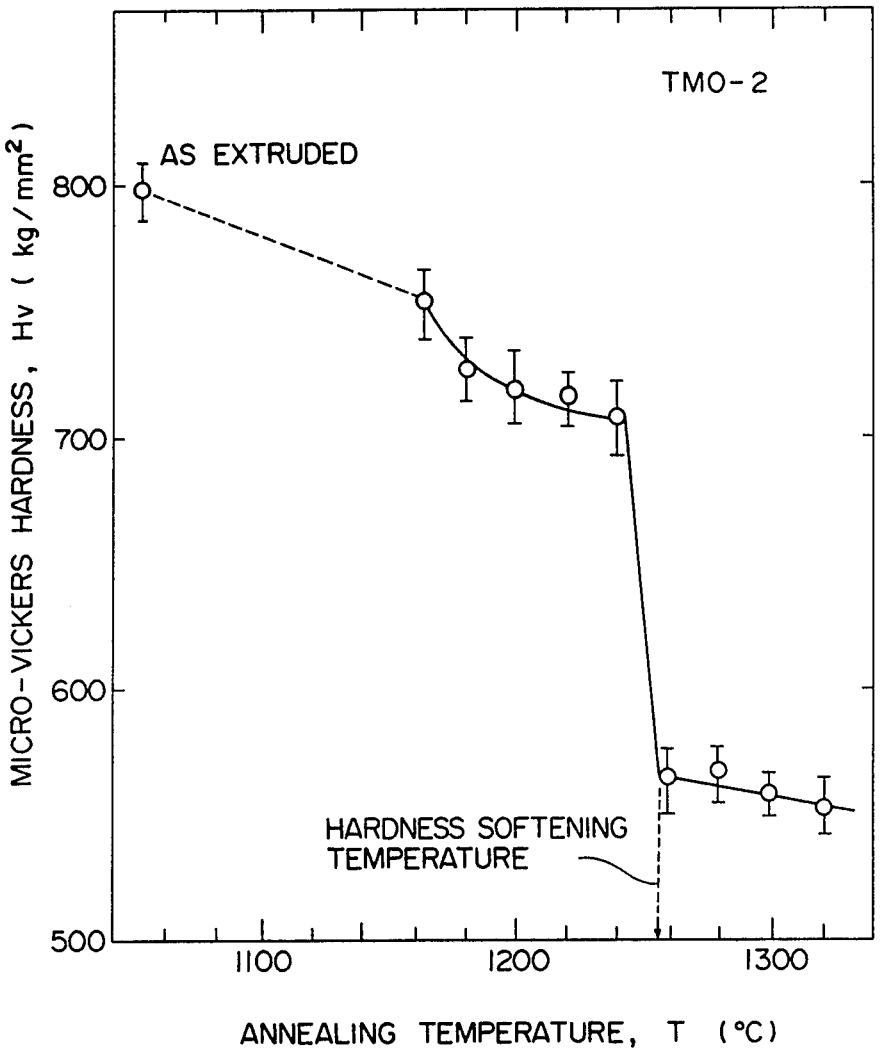
FIG. 1 is a graphic representation showing the relation between the annealing temperature (T) and the micro-Vickers hardness (Hv) which was obtained when extruded materials (TMO-2) in accordance with this invention were annealed for 1 hour at a given temperature and then air cooled, and thereafter its micro-Vickers hardness (Hv) was measured.

The component elements, the alloy composition and the action of yttria in a gamma-prime precipitation hardening nickel-base yttria particle-dispersion-strengthened superalloy of this invention will first be described.

Al is an element required for forming a gamma-prime phase. In order to precipitate the gamma-prime phase fully, Al should be included in an amount of at least 3.0% by weight. If, however, the amount of Al exceeds 6.0% by weight, the amount of the gamma-prime phase increases too much and the toughness of the alloy decreases. Accordingly, the amount of Al should be 3.0 to 6.0% by wight, preferably 3.0 to 5.1% by weight.

Co dissolves in the gamma phase and gamma-prime phase, and contributes to solid solution strengthening of these phases. If the amount of Co is less than 8.5% by weight, its strengthening action is not sufficient. If its amount exceeds 10.9% by weight, the strength of these phases decreases. Hence, the amount of Co should be 8.5 to 10.9% by weight, preferably 9.2 to 10.9% by weight.

Cr acts to improve the sulfidation resistance of the alloy. If the amount of Cr is less than 3.9% by weight, the sulfidation resistance of the alloy is reduced when it is used for an extended period of time at a temperature of at least 1,000° C. If its amount exceeds 7.5% by weight, deleterious phases such as alpha and mu phases are formed, and the creep rupture strength of the resulting alloy decreases. Hence, the amount of Cr should be 3.9 to 7.5% by weight, preferably 5.0 to 7.5% by weight.

W dissolves in gamma and gamma-prime phases to strengthen these phases greatly. For this purpose, the amount of W should be at least 11.4% by weight. If it exceeds 13.3% by weight, the amount of the gamma-prime phase decreases and rather the strength of the alloy is degraded. Accordingly, the amount of W should be 11.4 to 13.3% by weight, preferably 11.9 to 13.3% by weight.

Mo acts to precipitate a carbide in the grain boundary. If the amount of Mo is less than 1.3% by weight, the carbide cannot be sufficiently precipitated in the grain boundaries, and the grain boundary becomes weak. As a result, the grain boundary breaks before the alloy base shows sufficient ductility. If the amount of Mo exceeds 2.6% by weight, coarse carbide grains accumulate in the grain boundary during heat-treatment to reduce the grain boundary strength greatly. Accordingly, the amount of Mo should be 1.3 to 2.6% by weight, preferably 1.6 to 2.6% by weight.

Most of Ti dissolves in the gamma-prime phase to strengthened it and to increase the amount of the gamma-prime phase thereby strengthening the alloy. For this purpose, the amount of Ti should be at least 0.5% by weight. If the amount of Ti exceeds 1.2% by weight, a mu phase occurs to decrease the creep rupture strength of the resulting alloy. Accordingly, the amount of Ti should be 0.5 to 1.2% by weight, preferably 0.5 to 1.1% by weight.

Most of Ta dissolves in the gamma-prime phase to effect marked solid solution strengthening of the gamma-prime phase and also to improve the ductility of the gamma-prime phase. To obtain this effect, the amount of Ta should be at least 3.6% by weight. If, however, the amount of Ta exceeds 6.3% by weight, deleterious precipitates such as a sigma phase occur to decrease the creep rupture life of the alloy. Hence, the amount of Ta should be 3.6 to 6.3% by weight, preferably 3.6 to 5.6% by weight.

C acts to form three kinds of carbides, MC, $M_{23}C_6$ and $M_6C$, and strengthen the grain boundary of the alloy. To obtain this effect, the amount of C should be at least 0.001% by weight. If its amount exceeds 0.1% by weight, deleterious carbides precipitate in film form in the grain boundary during secondary recrystallization. Hence, the amount of C should be 0.001 to 0.1% by weight, preferably 0.03 to 0.07% by weight.

B segregates in the grain boundary and acts to increase the grain boundary strength at high temperatures and also to increase the creep rupture strength and rupture elongation of the alloy. To obtain this effect, the amount of B should be at least 0.001% by weight. If, however, its amount exceeds 0.02 % by weight, a deleterious boride which prevent grain growth precipitates in film form in the grain boundary during secondary recrystallization. Hence, the amount of B should be 0.001 to 0.02% by weight, preferably 0.005 to 0.01% by weight.

Zr, as does B acts to strengthen the grain boundary. To obtain this effect, the amount of Zr should be at least 0.02% by weight. If, however, the amount of Zr exceeds 0.2% by weight, intermetallic compounds form in the grain boundary, and the creep rupture strength of the alloy is rather reduced. For this reason, the amount of Zr should be 0.02 to 0.2% by weight, preferably 0.02 to 0.1% by weight.

The amount of oxygen other than oxygen contained in yttria should be as small as possible. However, the inclusion of some oxygen cannot be avoided since the alloy is produced from powdery materials. If the amount of the other oxygen exceeds 0.8% by weight, $TiO_2$, $Al_2O_3$ and composites of these with $Y_2O_3$ are formed. The formation of these compounds increases the size of the dispersed yttria particles, reduces creep strength and further accelerates the precipitation of deleterious filmy carbides or borides in the grain boundary. Accordingly, the amount of oxygen other than the oxygen contained in yttria should be not more than 0.8% by weight.

Yttria disperses uniformly in the base alloy and increases the creep rupture strength at high temperatures of the resulting nickel-base heat-resistant alloy. If its amount is less than 0.5% by weight, its effect is not sufficient. If, however, its amount exceeds 1.7% by weight, the strength of alloy is rather degraded. Accordingly, the amount of yttria should be 0.5 to 1.7% by weight, preferably 0.7 to 1.3% by weight.

The remainder of the alloy composition is Ni.

Now, the production of a gamma-prime precipitation hardening nickel-base yttria particle-dispersion-strengthened superalloy will be described. First, a nickel carbonyl powder, element powders of Co, Cr, Ta, W and Mo, alloy powders of Ni—Al, Ni—Ti—Al, Ni—Zr and Ni—B and a yttria powder are mixed mechanically to prepare a mixed powder. The nickel carbonyl used herein is nickel carbonyl containing a small amount, for example about 0.1% by weight, of carbon which is commercially available, for example from The International Nickel Company, Inc. The mechanical mixing may be effected by using a ball mill having agitating blades, a rotary drum-type ball mill, etc., preferably in an inert gaseous atmosphere such as an atmosphere of argon or helium.

The time required for mixing may be an time sufficient to give an intimately mixed powder. Usually, depending upon the mixing device used, the mixing time is 10 to 100 hours, preferably 40 to 60 hours.

The resulting mixed powder is sealed into an extrusion can such as a mild steel can, and extruded. At the time of sealing the mixed powder into the extrusion can, it is preferred to perform degassing at an elevated temperature of, for example, 300° to 450° C., preferably 350° to 400° C., under a vacuum of, for example, $1\times10$ to $1\times10^{-6}$ mmHg, preferably $1\times10^{-1}$ to $1\times10^{-5}$ mmHg, for a period of at least 20 minutes, preferably at least 1 hour. When the ratio of the length of a crystal grain along its long axis (extrusion direction) to that along its short axis [to be referred to as "GAR" (grain aspect ratio)] becomes at least 20, the creep strength of the resulting alloy becomes high. In order to obtain a coarse recrystallized structure with a GAR of at least 20 and a short axis diameter of at least 0.5 mm, the extrusion conditions such as the extrusion speed and extrusion ratio, and the zone annealing conditions such as the maximum temperature of the extruded material, the temperature gradient and the rate of movement, should be within proper ranges.

The extrusion conditions such as the extrusion temprature and the extrusion ratio affect the recrystallized structure after zone annealing.

If the extrusion temperature is less than 1,000° C., the extrusion cannot be performed, and is stopped. If, on the other hand, the extrusion temperature exceeds 1,100° C., the recrystallized structure after zone annealing has a GAR of less than 20, and lower creep strength. Hence, the extrusion temperature should be 1,000° to 1,100° C.

If the extrusion ratio is less than 12, the degree of extrusion is insufficient and a good recrystallized structure cannot be obtained. The recrystallized structure has a GAR of less than 20 and lowered creep strength. If the extrusion ratio is at least 12, the degree of extrusion is sufficient, and the recrystalilzed structure after zone annealing has a GAR of at least 20 and an increased creep strength.

In the zone annealing heat-treatment, the maximum temperature, the moving speed and the temperature gradient of the extruded material affect the resulting recrystallized structure.

The maximum temperature of the extruded material should be higher than its hardness softening temperature but lower than its solidus temperature. In the present application, the hardness softening temperature of the extruded material denotes a temperature at which its micro-Vickers hardness rapidly changes from 700 kg/mm$^2$ to 600 kg/mm$^2$ (see FIG. 1), and the solidus temperature denotes the upper limit of a temperature range within which partial dissolution of the material does not occur.

If the maximum temperature of the extruded material is lower than the hardness softening temperature, recrystallization does not take place and the extruded structure remains. Hence, the creep strength of the alloy is lowered. On the other hand, when the maximum temperature of the material exceeds the solidus temperature, it is partially dissolved and its structure becomes non-uniform with a reduction in creep strength. For the above reason, if the maximum temperature of the material is within the range of from its hardness softening temperature to its solidus temperature, coarse recrystallized grains having a short axis diameter of at least 0.3 mm, preferably at least 0.5 mm, can be obtained. Preferably the maximum temperature is 1,250° to 1,340° C..

The steeper the temperature gradient of the extruded material, the larger the GAR of the crystal grains. If the temperature gradient is less than 150° C./cm, the resulting structure has a GAR of less than 20 and a lowered creep strength. The temperature gradient should be at least 150° C./cm, preferably at least 200° C./cm.

The moving speed of the extruded material should be at least 20 mm/hour but not larger than 200 mm/hour.

If the moving speed of the extruded material exceeds 200 mm/hour, the structure of the center of the material cannot be maintained for a time period sufficient for recrystallization. As a result, the structure becomes non-uniform and has low creep strength. If, on the other hamd, the moving speed becomes lower than 20 mm/hour, the short axis diameter of the crystal grains increases, but the GAR becomes less than 20. Consequently, the creep strength of the resulting alloy is lowered.

The creep rupture life of the alloy, measured under creep conditions of 1,050° C. and 16 kgf/mm$^2$, is at least 4,000 hours.

By performing extrusion and zone annealing under the above-specified conditions, there can be obtained a gamma-prime precipitation hardening nickel-base yttria particle-dispersion-strengthened superalloy having a structure composed of coarse recrystallized grains with a GAR of at least 20 and a short axis diameter of at least 0.5mm.

The following examples illustrate the present invention more specifically.

EXAMPLE 1

Nickel carbonyl powder having a particle diameter of 3 to 7 micrometers, Cr power having a size of −200 mesh, W, Ta, Mo and Co powders having a size of −325 mesh, Ni-46% Al powder, Ni-28% - Ti-15% Al powder, Ni-30% Zr powder, and Ni-14% B powder, and $Y_2O_3$ powder having an average particle size of 20 mm were mechanically mixed for 50 hours in an atmosphere of Ar so as to provide the composition for TMO-2 shown in Table 1 (C was contained in the nickel carbonyl powder).

The weight ratio of steel balls to the starting powders at the time of mechanical mixing was 85(Kg):5(kg).

The resulting mixed powder was packed into mild steel cans, and each can was sealed after degassing at 400° C. under a vacuum of $2\times10^{-2}$ mmHg for at least 1 hour. The can was maintained at 1050° C. for 2 hours, and then extruded by at an extrusion ratio of 15:1 at a ram speed of 400 mm/sec.

The resulting material was heated to a maximum temperature of 1300° C. in an induction coil and moved in it at a speed of 100 mm/hour. The temperature gradient obtained along the material by a water cooling jacket in the apparatus was 300° C./cm. The recrystallized crystal grains had a size of 1–2 mm×several centimeters, and a GAR of more than 30. As a result, a gamma-prime precipitation hardening nickel-base yttria particle-dispersion-strengthened superalloy was obtained.

EXAMPLE 2

As in Example 1, a mechanically mixed powder having the composition for TMO-2 indicated in Table 1 was prepared, and extruded at an extrusion ratio of 15:1 and a ram speed of 400 mm/sec after being maintained at 1,080° C. for 2 hours in a sealed can. The resulting material was subjected to zone annealing under the same condition as described in Example 1.

EXAMPLE 3

Example 1 was repeated except that the starting powders were mixed so as to provide the composition for TMO-9 indicated in Table 1.

EXAMPLE 4

Example 2 was repeated except that the starting powders were mixed so as to provide the composition for TMO-7 indicated in Table 1, and the extruded material was subjected to zone annealing at 1,280° C. at a speed of 100 mm/hour.

The creep characteristics of the alloys obtained in Examples 1 to 4 were as shown in Table 2.

Table 3 shows the creep characteristics of alloy MA-6000 purchased from INCO.

TABLE 1

| | Al | Co | Cr | Ti | Ta | W | Zr |
|---|---|---|---|---|---|---|---|
| Alloy of the invention (described in claim 1; the parenthesized FIGS. show preferred ranges claimed in claim 2) | 3.0(3.0)–6.0(5.1) | 8.5(9.2)–10.9(10.9) | 3.9(5.0)–7.5(7.5) | 0.5(0.5)–1.2(1.1) | 3.6(3.6)–6.3(5.6) | 11.4(11.9)–13.3(13.3) | 0.02(0.02)–0.2(0.1) |
| Alloys of Examples 1 and 2 (TMO-2) | 4.2 | 9.7 | 5.9 | 0.8 | 4.7 | 12.4 | 0.05 |
| Alloy of Example 3 (TMO-9) | 3.1 | 10.3 | 7.4 | 0.6 | 3.7 | 13.1 | 0.05 |
| Alloy of Example 4 (TMO-7) | 4.9 | 9.3 | 5.1 | 1.0 | 3.7 | 12.0 | 0.05 |
| Alloy described in claim 1 of U.S. Pat. No. 3,926,568 | 2.5–6 | 0–10 | 13–17 | 2–4.25 | 0–4 | 3.75–6.25 | 0.02–0.5 |
| Commercial MA-6000 alloy | 4.5 | — | 15 | 2.5 | 2.0 | 4.0 | 0.15 |

| | Mo | C | B | $Y_2O_3$ | O | Ni | Others |
|---|---|---|---|---|---|---|---|
| Alloy of the invention (described in claim 1; the parenthesized FIGS. show preferred ranges claimed in claim 2) | 1.3(1.6)–2.6(2.6) | 0.001(0.03)–0.1(0.07) | 0.001(0.005)–0.02(0.01) | 0.5(0.7)–1.7(1.3) | 0–0.8 | balance | |
| Alloys of Examples 1 and 2 (TMO-2) | 2.0 | 0.05 | 0.01 | 1.1 | 0.47 | balance | |
| Alloy of Example 3 (TMO-9) | 2.5 | 0.05 | 0.01 | 1.1 | 0.5 | balance | |
| Alloy of Example 4 (TMO-7) | 1.7 | 0.05 | 0.01 | 1.1 | 0.7 | balance | |
| Alloy described in claim 1 of U.S. Pat. No. 3,926,568 | 1.75–4.5 | 0–0.2 | 0.001–0.025 | 0.4–2 | — | balance | Nb 0–3 Hf 0–3 |
| Commercial MA-6000 alloy | 2.0 | 0.05 | 0.01 | 1.1 | — | balance | |

TABLE 2

| Example | Sample No. | Creep conditions (°C.) | Creep conditions (kgf/mm²) | Rupture life (h) | Rupture elongation (%) | Reduction of area (%) |
|---|---|---|---|---|---|---|
| 1 | 1 | 1050 | 16 | 7476 | 4.1 | 8.8 |
| | 5 | 1050 | 18 | 1590 | 4.5 | 8.2 |
| | 4 | 960 | 23 | 1622 | 3.6 | 5.7 |
| | 2 | 850 | 35 | 1126 | 4.7 | 8.6 |
| | 3 | 850 | 40 | 102.6 | 4.8 | 8.5 |
| 2 | 6 | 1050 | 16 | 4992 | 1.3 | 4.9 |
| | 7 | 850 | 35 | 829 | 1.1 | 4.5 |
| | 8 | 1050 | 1.6 | 9434 | 1.7 | 3.1 |
| | 9 | 850 | 35 | 716 | 1.2 | 3.8 |
| 3 | 11 | 1050 | 16 | more than 4707 | | |
| | 12 | 850 | 35 | 437 | 3.6 | 6.7 |
| | 13 | 1050 | 16 | more than 4953 | | |
| | 14 | 850 | 35 | 559 | 0.9 | 2.3 |
| 4 | 15 | 1050 | 18 | more than 3012 | | |
| | 16 | 850 | 40 | 21.8 | 4.7 | 9.6 |
| Comparison | 17 | 1050 | 16 | 3500 | 3.7 | 7.0 |
| (*) | 18 | 900 | 25 | 4685 | 5.6 | 12.6 |

(*) Creep characteristics of the alloy obtained by isothermal annealing in accordance with an example in Japanese Laid-Open Patent Publication No. 48550/86 (filed August 14, 1984 and laid-open March 10, 1986) by the same inventors as the present ones.

TABLE 3

| Heat-treatment conditions Zone annealed | Creep conditions (°C.) | Creep conditions (kgf/mm²) | Rupture life (h) | Rupture elongation (%) | Reduction of area (%) |
|---|---|---|---|---|---|
| 1232° C. 30 min AC, 954° C. 2 hr AC, 845° C. 24 hr AC. | 1050 | 16 | 1400 | 1.6 | 2.7 |
| | 850 | 35 | 222 | 5.8 | 13.2 |

AC: air cooling

What is claimed is:

1. A gamma-prime precipitation hardening nickel-base yttria particle-dispersion-strengthened superalloy having a composition consisting essentially of, by weight, 3.0 to 6.0% of Al, 8.5 to 10.9% of Co, 3.9 to 7.5% of Cr, 0.5 to 1.2% of Ti, 3.6 to 6.3% of Ta, 11.4 to 13.3% of W, 0.02 to 0.2% of Zr, 1.3 to 2.6% of Mo, 0.001 to 0.1% of C, 0.001 to 0.02% of B, 0.5 to 1.7% of yttria ($Y_2O_3$), not more than 0.8% of 0 and the balance being Ni and having a structure composed of coarse recrystallized grains with a grain aspect ratio of at least 20 and a short axis diameter of at least 0.5 mm, said alloy having a creep rupture life, measured under creep conditions of 1,050° C. and 16 kgf/mm², of at leat 4,000 hours, said alloy having been produced by mechanically mixing a nickel carbonyl powder, element powders of Co, Cr, Ta, W and Mo, alloy powders of Ni—Al, Ni—Ti—Al, Ni—Zr and Ni—B, and a fine yttria powder in amounts to provide said composition, sealing the mixed powder into an extrusion can, extruding it, and subjecting the extruded material to zone annealing heat-treatment while its maximum temperature is within the range from its hardness softening temperature to its solidus temperature.

2. The alloy of claim 1 wherein the extrusion is carried out at a temperature of 1,000 to 1,100° C.

3. The alloy of claim 1 wherein the extrusion is carried out at an extrusion ratio of at least 12.

4. The alloy of claim 1 wherein the maximum temperature of the extruded material during zone annealing heat-treatment is 1,250 to 1,340° C.

5. The alloy of claim 1 wherein the moving speed of the extruded material during zone annealing heat-treatment is 20 mm/hour to 200 mm/hour.

6. The alloy of claim 1 wherein the temperature gradient of the extruded material during zone annealing heat-treatment is at least 150° C./cm.

7. The alloy of claim 1, said alloy having a composition consisting essentially of, by weight, 3.0 to 5.1% of Al, 9.2 to 10.9% of Co, 5.0 to 7.5% of Cr, 0.5 to 1.1% of Ti, 3.6 to 5.6% of Ta, 11.9 to 13.3% of W, 0.02 to 0.1% of Zr, 1.6 to 2.6% of Mo, 0.03 to 0.07% of C, 0.005 to 0.01% of B, 0.7 to 1.3% of yttria ($Y_2O_3$, not more than 0.8% of O and the balance being Ni.

8. The alloy of claim 7 wherein the extrusion is carried out at a temperature of 1,000 to 1,100° C.

9. The alloy of claim 7 wherein the extrusion is carried out at an extrusion ratio of at least 12.

10. The alloy of claim 7 wherein the maximum temperature of the extruded material during zone annealing heat-treatment is 1,250 to 1,340° C.

11. The alloy of claim 7 wherein the moving speed of the extruded material during zone annealing heat-treatment is 20 mm/hour to 200 mm/hour.

12. The alloy of claim 7 wherein the temperature gradient of the extruded material during zone annealing heat-treatment is at least 150° C./cm.

* * * * *